United States Patent [19]

Hoberstorfer et al.

[11] 4,377,353

[45] Mar. 22, 1983

[54] METHOD OF SELECTIVE UNDERGROUND MINING AND STABILIZATION OF ROCK CAVITIES

[75] Inventors: Gustav Hoberstorfer, Järfälla; Torsten Noren, Täby, both of Sweden

[73] Assignee: Gränges AB, Stockholm, Sweden

[21] Appl. No.: 190,851

[22] PCT Filed: Jul. 27, 1979

[86] PCT No.: PCT/SE79/00162

§ 371 Date: Apr. 1, 1980

§ 102(e) Date: Apr. 1, 1980

[87] PCT Pub. No.: WO80/00361

PCT Pub. Date: Mar. 6, 1980

[30] Foreign Application Priority Data

Aug. 3, 1978 [SE] Sweden ..... 7808366

[51] Int. Cl.[3] ..... E02D 19/14; E21C 41/00

[52] U.S. Cl. ..... 405/130; 299/11

[58] Field of Search ..... 405/53, 56, 130, 258; 299/11, 12

[56] References Cited

U.S. PATENT DOCUMENTS

| | | | |
|---|---|---|---|
| 1,207,569 | 12/1916 | Langerfeld | 299/11 |
| 1,717,005 | 6/1929 | Carrier | 299/12 X |
| 2,932,170 | 4/1960 | Patterson et al. | 405/56 |
| 3,183,675 | 5/1965 | Schroeder | 405/130 X |
| 3,205,665 | 9/1965 | Van Horn | 405/56 |
| 3,302,407 | 2/1967 | Every | 405/56 |
| 3,350,888 | 11/1967 | Shier | 405/130 |
| 3,646,765 | 3/1972 | Bodle et al. | 405/56 |
| 3,790,215 | 2/1974 | Fangel | 299/11 |
| 4,219,237 | 8/1980 | Sisemore | 299/11 X |

FOREIGN PATENT DOCUMENTS

| | | | |
|---|---|---|---|
| 92249 | of 1958 | Norway | 299/11 |
| 389371 | of 1971 | Sweden . | |

*Primary Examiner*—Stephen J. Novosad

*Attorney, Agent, or Firm*—Burns, Doane, Swecker & Mathis

[57] ABSTRACT

The invention relates to a method of underground mining mineral or preparation of rock cavities, in which method resulting hollow spaces can be refilled entirely or partially with temporarily stabilizing ice. The hollow space resulting from the mining is prepared in a first step for ice filling in that the geothermal heat content in the walls of the hollow space partially is removed, so that the walls assume a temperature below 0° C. In a second step water is supplied, possibly together with a reinforcing additive, in layers and intermittently to the hollow space while the supplied water together with the possibly added reinforcing agent is being cooled and frozen. In a third step the frozen ice body is maintained by removing the constantly inflowing geothermal energy during a time period deemed necessary for achieving the object. The cooling preferably is effected by artificially cooled air. The first step and the third step, however, can be abolished when the climatic conditions are such, that the rock about the hollow space is frozen to below the freezing point. The cooling air flows in a closed system which is entirely separated from the ventilation air.

16 Claims, 28 Drawing Figures

METHOD OF SELECTIVE UNDERGROUND MINING AND STABILIZATION OF ROCK CAVITIES

BACKGROUND AND SUMMARY OF THE PRESENT INVENTION

In mining technology one usually distinguishes between two main types of mining, viz. open cut mining and underground mining. This invention relates to the latter category. Within underground mining technology three different main methods can be distinguished.

(1) Mining with and by remaining pillars for timbering and maintaining hollow spaces obtained by mining. This method has a relatively good selectivity, but causes mineral loss, at least temporarily unless the pillars are recovered in the final phase (hereby the method transforms to method 3 below).

(2) Caving by permitting layers or blocks and overlying rock to collapse down into hollow spaces resulting from extraction in order thereby to fill the spaces and create a protective layer against collapsing rock parts and blocks. This method has poor or almost no selectivity. It causes, substantial ore losses or, alternatively, substantial gangue admixture, depending on which of the two extremes is preferred.

(3) Cutting and filling hollow spaces obtained by extraction, by using valueless material such as gangue, sand, waste from mineral processing plants (dressing plants) etc. This filling is planned and artificial, and it presupposes access to suitable fill material. Thus, it is expensive and at times even very expensive. The method, consequently, presupposes that the mineral to be mined is relatively valuable, which implies that mining losses must be small and/or that the subsequent processing of the product in mineral processing (dressing) plants is relatively expensive so as to permit utilization of the other great advantage of the cut- and-fill method, viz. low gangue admixture. The method, thus, is selective. It also may have a third advantage, which more recently has become important, i.e. its environment protective effect, because certain grain size fractions of the waste from subsequent mineral processing (dressing) plants can be recycled to the mine and be used as fill. The fill is supplied to the mine with the object of stabilizing the hollow spaces and preventing them from collapsing.

The present invention relates to a method of underground mineral mining or preparing rock cavities, at which method resulting cavities or hollow spaces entirely or partially are filled with stabilizing ice, either temporarily or, when desired, permanently, but normally temporarily as will become apparent from the following.

The method substantially can be correlated to method (3) where the conventional filling masses are replaced by ice, and it can, like method 3 in its general form be applied to method (1), i.e. mined parts in a mineral deposit can be filled with ice, whereafter the pillars can be recovered. The method according to the invention also can be applied to preparing and mining rock cavities for the storage of solid, gaseous or liquid material.

For facilitating its understanding and describing it more simply, the invention in the following is compared explicitly or implicitly with so-called cut- and-fill mining of mineral deposits, in other words with the mining method, at which the mined mineral deposit or extractable parts of a mineral deposit have been replaced for stabilizing purposes by artificially supplied fill, more precisely by fine-grained material, which in aqueous suspension had been supplied to the mined deposit or parts thereof, so-called filling with hydraulic fill. For elucidating the invention still more and describing it in greater detail, in the following the invention is compared with the cut-and-fill method by using hydraulic fill which, besides, was stabilized by the addition of a binder in order to render possible both so-called upward and downward filling. The binder most usually being cement, the invention primarily is compared with cut-and-fill mining by using cement-stabilized hydraulic fill. The invention, thus, is compared with, and its applicability is described in comparison with the mining of mineral deposits, but, as mentioned, the utilization of the invention is not restricted only to the mining of mineral deposits. The mining and preparation of rock cavities in general also can be facilitated by applying the invention.

As mentioned above, at the cut-and-fill method fill masses, according to the invention ice, are supplied to mined rock cavities for stabilizing the same. The invention can be applied to both upward and downward mining direction with the cut-and-fill method of mineral deposits.

For obtaining a definite size of the mining spaces, the strength of the rock and the minerals as well as of the ice must be taken into consideration.

When mining a mineral deposit by the cut-and-fill method and in upward direction, the strength of the mineral-bearing rock is the limiting factor with respect to the width (span) in a so-called mining space (layer). The height of the layer is determined by the width of the mineralized zone and by the strength of the mineralized rock and/or the strength of the so-called wall rock. When using downward cut-and-fill mining with cement-stabilized hydraulic fill, also the strength of the hydraulic fill is a layer span limiting factor.

Due to the fact that, as will be shown later, one of the advantages of the invention is the applicability of downward mining direction, and as at normal cut-and-fill mining with cement-stabilized hydraulic fill and the use of reasonable cement quantities (mean mixture ratio cement:fill 1:6), the approximate span of the cavities is 6 m, provided its permission by the width of the mineralized zone, the cavity span in the following is assumed to be 6 m. A space height of 4 m has been assumed usual and normal.

It was mentioned above that the caved mining spaces temporarily or permanently were filled with ice. Although the invention per se does not intend to permit the ice to melt in a space while work is going on in spaces immediately below or, with other words, the term "temporarily" covers a relatively short time interval, calculations carried out have proved that an ice beam (ice layer) of 6 m width and 3 m height resists with ample margin the spontaneous load of immediately overlying and collapsing rock.

This situation is a theoretical one, because rock collapse and downward mining direction will not be permitted while work is going on, but is prevented by retaining the ice masses.

The theoretical case described, however, shows that the invention meets the safety requirements. Besides, that the work safety beneath an artificial ice roof is greater than beneath a natural rock roof, should be obvious, as it, too, is obvious that the assumed space size parameters of 6 m width and 4 m height can be reduced according to the configuration of local mineral deposits and special wishes.

When, however, the mineral deposit configuration is of such a nature that the space width should substantially exceed about 6 m, mining in multiples of adjacent spaces must be applied.

Previously it has been proposed to utilize ice for the above purpose, but to our knowledge the proposals never have been realized in production operation.

One proposed method uses ice, which was permitted at an open pit to flow (creep) into the hollow spaces created by mining. The method, thus, presupposes an opening of substantial area and vertical distance between the pit and the earth surface, and further requires access to natural ice on the earth surface and/or at least a relatively cold climate for being able to make the required fill ice without great losses. For rendering it possible for the ice to creep into the pit with sufficient speed, a sufficiently high overlay pressure (ice thickness) is required, and the temperatures must not be too low, which is somewhat contrary at least to the requirement of having a relatively cold climate for being able, if necessary, to make ice by watering the open pit.

The method, besides, has the disadvantage that its utilization requires relatively large mineral deposits, and that it permits mining only in downward direction and always in direct connection to the overlying ice. The method, thus, lacks any possibility of selective mining, i.e. mining in any optionally selected place underground.

The production pace in the mine, besides, depends directly on the creep speed of the ice and, thus, cannot be controlled unconditionally.

The method suitably can be applied at the mining of large mineral deposits according to the sub-level caving method.

Another known method is related somewhat more closely to the present invention and permits a certain selectivity, due to the fact that relatively high vertical cavities are permitted being filled with snow, which by its own weight is compacted to ice at least in the lower layers. The snow is produced by blowing preferably cold atmospheric air through a water curtain. The method of producing the necessary snow at high temperature is only indicated by the statement, that refrigerating units can be used, without giving any detailed instruction.

Ice losses by natural melting are balanced by adding snow or are reduced by heat-insulating the ice body against the surrounding rock. Application of artificial cooling through cooling coils and channels is indicated.

The main object of the present invention is achieved in that the created cavity, in a first step, for a certain period is prepared for ice filling by partially removing the geothermic heat content in the cavity walls, so that the walls have a temperature below 0° C., and in a second step water, possibly together with material increasing the ice strength, for example fine-grained or fibrous material, is supplied in layers and intermittently to the cavity, while the added water together with possibly added material increasing the ice strength is being cooled and frozen, and in a third step the frozen ice body is maintained by removing the geothermic energy constantly flowing in during a period deemed necessary for achieving the object, and that said cooling and freezing in all three steps preferably is carried out with artificially cooled air, but that the first and the third steps can be abolished when the climatic conditions are such, that the rock about the cavity is frozen sufficiently below the freezing point, so that ice of high strength is obtained in a natural way, and that at suitable climatic conditions also the cooling in an artificial way in the second step can be imagined to be abolished.

It seems reasonable to assume that under such conditions also the atmospheric air has such a low temperature as to permit its lower heat content being utilized directly, without help by artificial cooling. The cooling air, for understandable reasons, in all three steps must be given a temperature below 0° C., suitably below −5° C., preferably below −10° C. and most preferably below −15° C., so that the ice has sufficient strength and low creep. These physical temperatures of the ice, namely, increase or decrease substantially at temperatures below −10° C.

When the temperature of the atmospheric air is not in agreement with the aforesaid, artificial cooling of the air or a combination of artificial cooling and natural cold air is applied, possibly depending on the season.

The principle, however, still is that the cooling air is given the necessary low temperature by artificial cooling (cooling-coil batteries), and that low geothermic rock temperature and low atmospheric air temperature are positive factors for the overall economy of the invention, but are not fundamental requirements.

Calculations carried out prove that the total costs of the method are of the magnitude half the total costs of cut-and-fill mining with cement-stabilized hydraulic fill, even when the mean temperature of the atmospheric air is about +30° C. (and the geothermic rock temperature at the same time is about +30° C.). The application range of the invention is thereby practically almost independent of the geographic location of the place of application.

The cooling air generally and in principle must flow in a closed system, entirely separated from the normal mine ventilation system, in order to create acceptable climatologic working conditions for the personnel and, due to the cooling air being in a closed system, to provide the prerequisites to more simply check and maintain cooling air volumes, cooling air temperature, etc.

In order to ensure a reasonable freezing time for the second step, the walls of the cavity in the first step should be frozen by flowing air to a layer of at least some decimeters thickness to a temperature below 0° C. Thereby a cold barrier is established against the geothermic heat flowing in and against the heat from the freezing water added in step two.

The conditions within the cold barrier, viz. its depth and the configuration of the temperature gradient over the frozen barrier depth (thickness), can be varied depending, among others, on the temperature levels of the geothermic heat and of the water as well as on the fixed lengths of the subsequent periods of ice-freezing and of cooling for maintaining the ice. This preparatory freezing preferably should be carried out so that, when the temperature is measured 0.5 m inside of the defining surface between cavity and rock into the rock, the temperature there should be −3° C. at maximum, preferably lower.

The second step then can be commenced. The water added in the second step suitably should have a temperature immediately above 0° C., preferably about +1° C. to +2° C., and the water preferably is spread intermittently and in layers. The flowing cooling air in the second step preferably is added also intermittently, substantially in pace with the spread of water, so that the cooling air entirely or partially is stopped during the water spread periods. When no spread takes place, the cooling air may flow at full speed and freeze the added water layer.

The cooling air shall cool as efficiently as possible. The cooling air, therefore, suitably by means known per se, for example by fans, guide bars or dampers, and advantageously assisted by process computers, should be given such a speed in the closed system that the cooling energy required for the different steps is supplied to the contact surfaces exposed to cooling, so that the surfaces within a reasonable time assume the desired temperature during the period in question of the method step. At given parameters such as the geothermic temperature of the rock, the desired configuration of the artificially created cold barrier against the geothermic heat, the temperature of the atmospheric air, the electric energy price etc., the question of the necessary cooling air quantity, and therewith the speed of the cooling air, is a problem of optimization.

The cooling air flows to the mining spaces through conduits, usually drifts or raises. The lastmentioned ones usually have a cross-sectional area of about 10 $m^2$, which also has been assumed as calculation basis for the invention. Due to aerodynamic conditions, the air speed in these drifts and raises suitably should be limited to about 10 m/s. When the air enters the mining space, which has a cross-sectional area of about 24 $m^2$, the air speed drops to about 4 m/s. This speed cannot be regarded satisfactory and, therefore, turbulence is created in the air stream by auxiliary fans, guide bars and the like, so that the air along the contact surfaces exposed to cooling assumes a speed of about 10 m/s, at which speed the heat transfer is improved (i.e. cooling energy is supplied more efficiently). Thereby, the cooling can take place in a shorter time than when the speed was only 4 m/s. In principle, however, any cooling air speed and any cooling air volume, within reasonable limits, can be chosen.

During the ice freezing, other requirements on cold air stream adjustment arise. When the water spreading is chosen to be carried out intermittently, first of all it must be possible to stop, or to very substantially reduce the air flow while the water is being spread. Furthermore, even during the intervals, i.e. when no water is being spread, adjustment must take place in order to obtain the correct air speed and air volume later on when the ice layer grows in thickness, i.e. the cross-sectional area decreases. The adjusting can be controlled by scanning means known per se, which emit sinals, for example to a process computer, which according to a predetermined programming emits signals so, that the desired adjustments are carried out. All this takes place in agreement with known process control technology.

The ice freezing or ice production step at downwardly directed mining is carried out so that a gap (cooling gap) remains between the upper defining surface of the frozen ice beam and overlying rock or ice beam. The gap has a height of about 1 m and, thus, a cross-sectional area of about 6 $m^2$. The gap is intended for the third step, the so-called maintenance-cooling, and thus is a part of the aforesaid closed system, through which the cooling air is to circulate during the period deemed necessary for maintaining the ice for stabilization purposes.

At upward mining direction, where the ice is the sole in a mining space, the possibility of making this cooling gap in an equally simple way does not exist.

When under upward mining direction conditions a cooling gap is deemed necessary, it can be provided by placing a simple thin-walled metal sheet, plastic or cardboard, tubes or boxes on the sole of a mining space before the ice production is commenced.

Another possibility is to drill vertical bores of a suitable diameter through the ice and thereby bring about vertical cooling slits for maintenance cooling.

It may happen that the rock proper holds a temperature so low, that maintenance cooling is not required. In this case, as already mentioned, the third step is abolished.

The present method in principle is based on an artificial cooling of the cooling air to preferably below −10° C., most preferably −15° C. and at times to, for example, −25° C. For overall economic reasons it may be desirable occasionally to fall below −15° C. to, for example, −25° C. in order to increase the mining capacity for a given mine or mine section. When due to high geothermic rock heat preparatory cooling (pre-cooling) of a space is applied, and when possibly also later on the produced ice is subjected to maintenance cooling, for the same reasons under conditions of prevailing low mean temperatures of the atmospheric air, the heat removed from the rock, of course, can be supplied to the normal mine ventilation air by help of the cooling air for its possible heating through the heat exchanger in the closed cooling air system.

At the ice production in the second step, material increasing the strength of the ice (reinforcing additives) possibly may be admixed to the water.

It was found by experiments that, for example, the bending strength of the ice can be increased by up to 200% by the admixture of about 10 percent by weight of fine-grained material. The increase in strength increases significantly at decreasing grain size, at least within the range 0.1–0.05 mm. It was found suitable to use fine-grained material originating, for example, from dressing plants at mines. Extremely fine-grained material fractions in the waste from these plants when being deposed, for example, in waste pools gives rise to troubles unless special measures such as pH adjustment and availability of a large waste pool surface are taken. In this connection problems with metal ions have been observed.

Environmental problems arising from the aforesaid negative factors, viz. fine-grained waste material and metal ions, can be solved partially, in certain cases probably completely, by using waste water from the dressing plants as water for the ice fills. Super-fine waste grain fractions, which probably have no strength-increasing effect for the ice, are baked into the ice, rendered harmless and remain in the mine even after the ice was permitted to melt.

It is known previously and can be applied also in this case, that fibre reinforcement can increase the tensile strength of the ice by more than 100%, when about 10 percent by volume of organic fiber, for example wood fiber, is admixed.

BRIEF DESCRIPTION OF THE DRAWINGS

The invention is described in the following, with reference to the accompanying drawings, in which.

DETAILED DESCRIPTION OF THE PREFERRED EMBODIMENT

Figure 1:
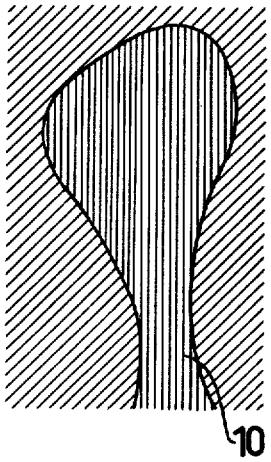
FIGS. 1–4 are schematic views illustrating different steps at the mining of an ore body according to the invention.
Figure 2:
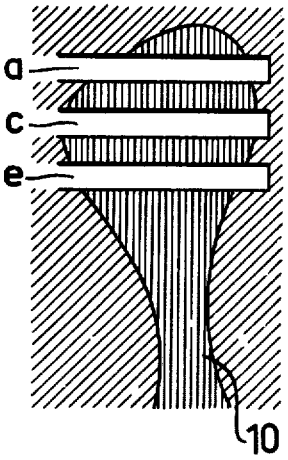

FIG. 1 shows a mineral deposit 10. The mining, as appears from FIG. 2, can be carried out by mining in layers, for example the layers a, c and e. These layers a, c and e are spaced sufficiently from each other in vertical direction in order to prevent the risk of collapse.

Figure 3:
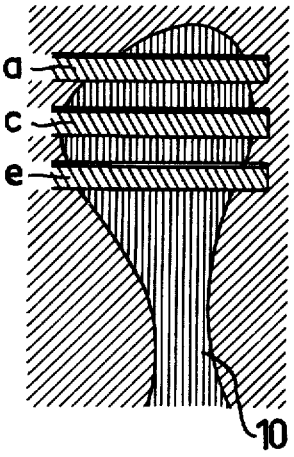
Figure 4:
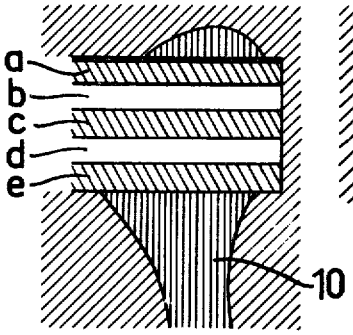

Subsequent to the aforesaid mining, according to the invention the hollow spaces a, c, e are refilled by introducing layers of water into the hollow spaces or layers (FIG. 3) and causing the water to freeze. Thereby a massive stable ice fill body (ice beam, ice layer) is obtained for stabilizing the hollow space and for rendering it possible to mine the remainder of the mineral deposit. This mining can take place, as shown in in FIG. 4, in the remaining layers b and d. In this manner, the mining in the mineral deposit shown in FIGS. 1–4 can continue until all mineral has been removed.

Figure 5:
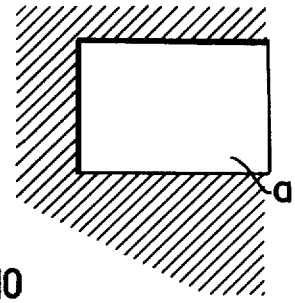
FIGS. 5–9 are schematic vertical sections taken at 90° to the sections of portions of FIGS. 1–4 of the same mining.
Figure 6:
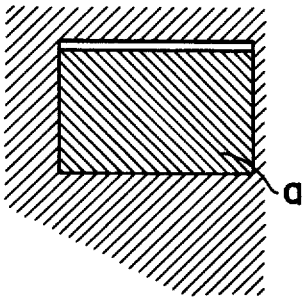
Figure 7:
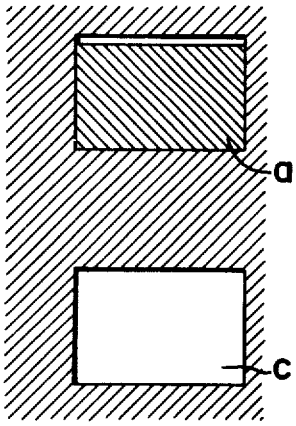
Figure 8:
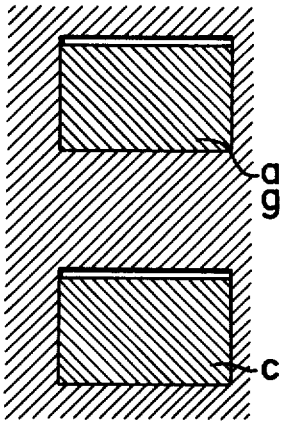
Figure 9:
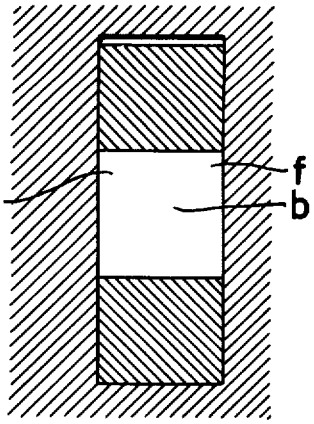

It should become apparent from this schematically described example, that the rock conditions are very stable, because all layers have the same height, and every second layer has been removed. It is, consequently, at liberty in this example whether the layers b and d mined in the second phase are to be filled with ice or remain unfilled. In FIG. 5 the mined layer a is shown by vertical section, and in FIG. 6 the same layer is shown filled with an ice body. In FIG. 7 the mined layer c is illustrated, and in FIG. 8 the layer c is shown filled with an ice body. The ore body portion lying between the ice bodies and designated by b in FIG. 9 now can be mined by using the underlying ice body as working platform and the overlying ice body as roof.

In all ice-filled layers a slit has been left in the upper portion of the layer for maintenance cooling.

When the mining has been completed, and the stabilization of the entire area or a part thereof is no longer necessary, the ice body may melt and the rock collapse. At melting, the freezing energy from the melting ice fill can be utilized for cooling or assisting in cooling the water in another area, for example by heat exchange. In cold climate or where necessary, the created ice body, which replaces the removed mineral body, can be maintained either by natural maintenance cooling or by artificial maintenance cooling in order to prevent collapse in the hollow underground spaces, collapse and loosening of the surrounding rock masses and, finally, possible formation of cavities in and/or sinking of the ground surface.

The cooling air required for pre-cooling of rock cavities and for ice production as well as for ice maintenance should have a temperature of between −15° C. and −11° C. Consequently, "free" circulation of this cooling air in the mine, i.e. simultaneous use of this cooling air as ventilation air, is excluded or at least not desirable.

The cooling air required for pre-cooling, ice production and ice maintenance, therefore, must or should circulate in a closed cooling air system without direct contact with the normal mine ventilation system.

Such a closed cooling air system in principle is not more complicated than a normal ventilation system and comprises the same components as a normal ventilation system, except for one or more cooling batteries to be added unless the temperature of the atmospheric air is so low that the battery or batteries can be abolished.

Figure 10:
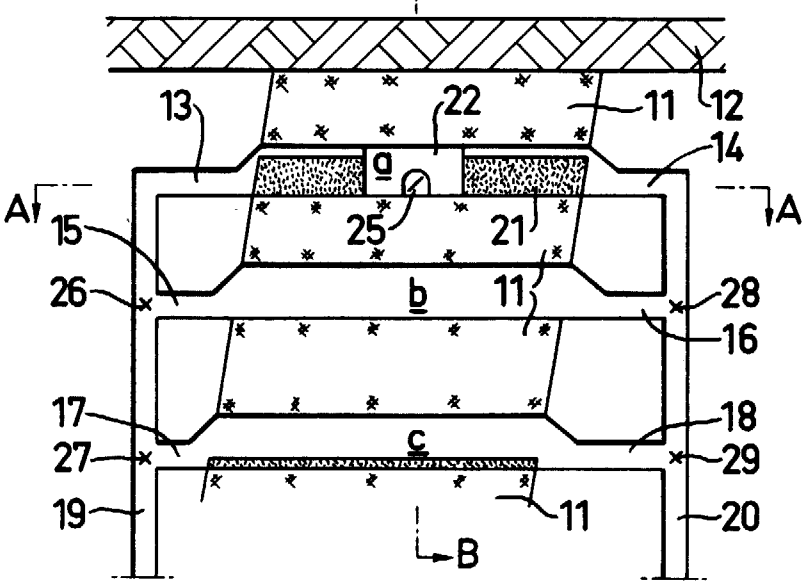

The location of the cooling air ventilation ducts depends on the configuration of the mineral deposit. When, for example, the configuration is steep upright, the cooling air ventilation duct or raises are placed in deans or in the foot wall. At the example shown in FIGS. 10–12 the cooling air raises are placed in deans. FIG. 10 is a vertical section through an imaginary mining area, FIG. 11 is a horizontal section along the line A—A in FIG. 10, and FIG. 12 is a vertical section along the line B—B in FIG. 10.

Figure 12:
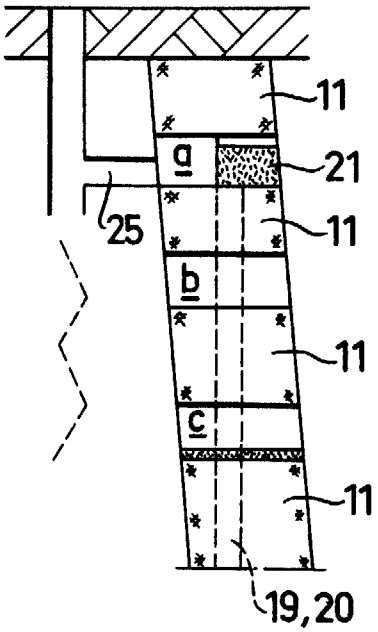
FIGS. 10–12 are schematic views of an embodiment of a closed cooling ventilating system according to the invention.
Figure 11:
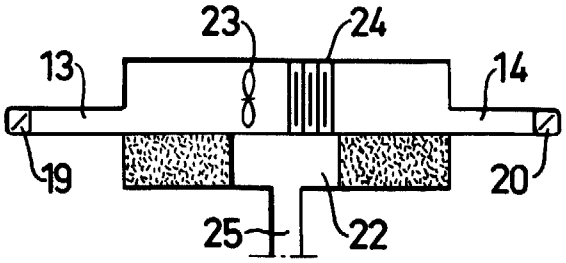

In FIGS. 10–12 an ore body 11 with overburdens 12 is shown. Three layers a, b and c have been mined. The layers are connected through drifts 13, 14, 15, 16, 17 and 18 to cooling air raises 19 and 20, which are connected by a drift in the mine bottom (not shown) and by the layer a partially filled with ice. The cooling air raises at this example have been given a cross-sectional area of about 9 $m^2$($\sim\phi 3$ m). This area is deemed substantially optimum from a driving of raises aspect and for rendering possible, without great aerodynamic losses, the supply of the cooling air volume, which is required for the pre-cooling and the ice production under reasonable periods and for the maintenance cooling, i.e. with air speeds not exceeding 10 m/s in the raise.

The maximum cooling air supply, consequently, is about 100 $m^3$ per second and raise, which at 6 m space width and 4 m space height, i.e. 24 $m^2$, yields an air speed of about 4 m/s in the initial phase, i.e. during the pre-cooling phase and at the beginning of the ice production phase.

With the same motivation as above, viz. necessary minimum cooling air volume for process step times of reasonable length and restriction of the transported air volume in the raises due to highest permissible air speeds (owing to aerodynamic losses), double cooling air raises generally are deemed necessary for a mine or part of a mine with two mining spaces in production. One pair supply and exhaust air for ice production in a layer, and one pair supply and exhaust air for pre-cooling of a second space. After completed pre-cooling of the second space, this cooling air raise pair are used for ice maintenance cooling (in FIGS. 10–12, however, only one pair of raises are shown).

In FIGS. 10–12 in layer "a" maintenance cooling of the ice layer 21 is going on, in layer "b" a mined space is precooled before ice production, and in space "c" ice is being produced.

In layer "a" the cooling space 22 has been installed immediately after the mining of the layer. Said cooling space encloses machinery and motor for the main fan 23 for the closed cooling air ventilation system and cooling units or the cooling battery 24.

It is obvious that the cooling space also can be placed in the footwall, in order to utilize the "first layer" or, when desired, it also can be placed on the ground surface. At the lastmentioned alternative, however, an extra shaft or an extra ramp must be driven, for obvious reasons, as a connection to the closed underground cooling air system.

The cooling space 22 communicates with the mine through the drift 25, which serves as a servive drift for the cooling space 22.

The necessary air flow to the different layers is controlled by dampers 26, 27, 28 and 29 according to the cooling air demand of the layers which in turn depends on the operation step just going on, i.e. pre-cooling, ice production or ice maintenance. The dampers and the entire cooling air system advantageously are controlled by a process computer. In other respects, it is of no importance whether the mine is developed through shafts or platforms as indicated in FIG. 12.

The air required for the normal and proper ventilation of the mine in order to dilute and remove waste gases, explosion gases, dust etc. is supplied and removed through a normal mine ventilation system, which is independent and separated from the cooling air system. This system is not shown in the Figure.

In spite of their independence of each other, the two air systems are related to each other indirectly by the desired temperature of the normal mine ventilation air.

When the invention is being applied, one mining space in steady-state condition always is in contact with ice, either in the sole (upward mining) or in the roof (downward mining). Too high a temperature of the normal ventilation air, of course, is of disadvantage for the method according to the invention. It was assumed, therefore, that the normal mine ventilation air is cooled (or heated, if desired) to about +1° C. to +2° C.

In an economic summary of the invention, it is asserted that the method, compared with cement-stabilized hydraulic fill, advantageously can be applied under external climate conditions exceeding even +30° C. as mean free air temperature. In normal cases, thus, the normal mine ventilation air is to be cooled.

It also is to be observed that in cases when the normal mine ventilation air is to be heated, the waste heat energy of the cooling batteries can be utilized, which is a substantial economic advantage in cold climates.

Figure 13:
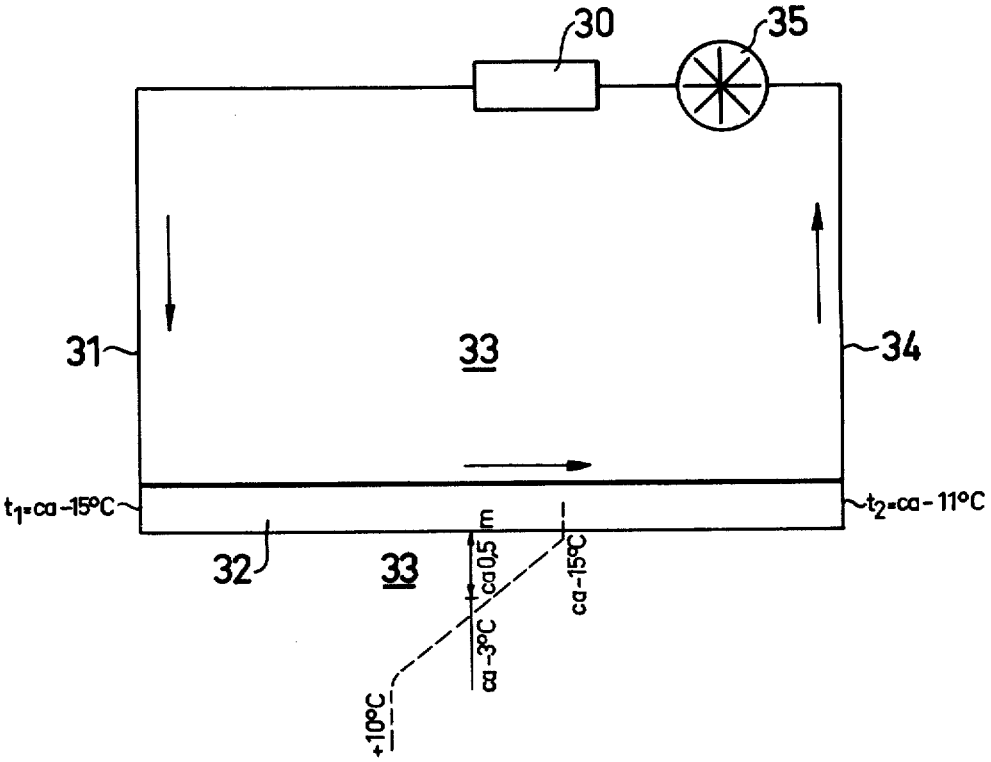
FIG. 13 is a schematic manner and in greater detail how this system is planned to operate.

In FIG. 13 is shown in detail how the pre-cooling can be carried out under certain conditions.

The object of pre-cooling is to prepare the mining space (layer) for freezing supplied water to ice and to build up a cold barrier of frozen rock of sufficient depth to resist and balance by so-called maintenance freezing the continuously supplied and barrier-decreasing effect of in situ rock heat, i.e. the natural heat content of the rock.

In FIG. 13 the natural rock temperature has been assumed to be +10° C. (In normal cases this corresponds to a mining depth of ~300 m).

The ice production preferably should take place, and is most economic at −15° C. to −11° C., whereafter the ice should be maintained at this temperature in view of strength phenomenon. The good economy is explained by the fact that at the temperatures proposed above only one refrigeration plant with one compressor step is required.

It is stipulated, consequently, that also the rock surface, i.e. the contact surface between rock and ice, preferably is to be cooled to about −15° C.

In order to maintain the continuous existence of the necessary cold barrier for the period deemed necessary, it finally is stipulated and calculated that the rock preferably should be frozen to at least −3° C. over a depth of about 0.3–0.5 m counted from the contact surface.

It is assumed in the following, still in agreement with FIG. 13, that the mine or level is of such a size as to render possible simultaneous mining on several levels. A refrigerating unit 30 positioned above or below the ground surface delivers cooling air to a raise 31 with a cross-sectional area of about 9 $m^2$. The air preferably has a temperature of about −15° C. in the raise 31. The air continues into the mining space 32, which has a cross-sectional area of about 25 $m^2$. The rock 33 surrounding the mining space has a temperature of about +10° C. The cooling air after having passed the mining space 32, which in this case has a length of 100 m, has cooled said space and itself been heated to −11° C. The air thereafter continues upward in the raise 34, which has a cross-sectional area of about 9 $m^2$, to the fan 35 and back into the refrigerating unit 30. The length of the raises 31 and 34 is about 50 m.

Under the prerequisites shown in FIG. 13 the space 32 is cooled to the above desired temperatures within some days. In FIG. 13 a temperature gradient (dashed line) is drafted schematically for elucidatory purposes.

Figure 14:
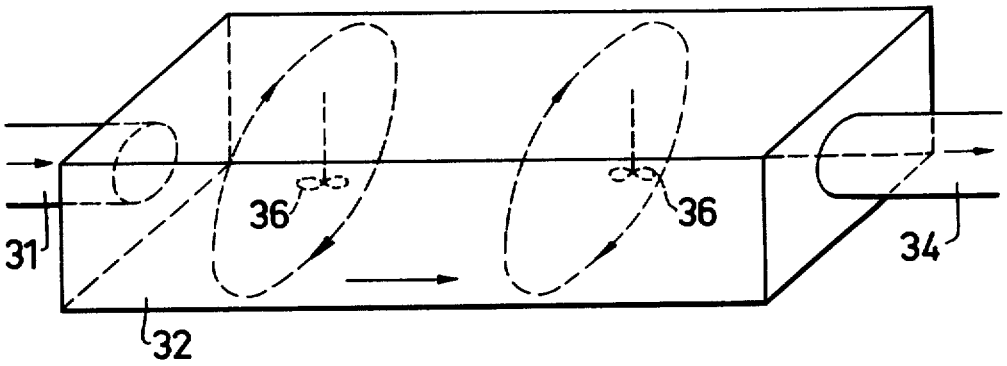
FIG. 14 is a schematic view of an example for creating turbulence in a mining space.

In FIG. 14 the same reference numerals are used as in FIG. 13, to an extent deemed suitable. The air entering from the raise 31 has a speed of about 10 m/s. When the air enters the mining space 32, which has an area of about 24 $m^2$, the mean speed of the air is not higher than about 4–5 m/s. It is suitable, therefore, to mount simple auxiliary fans 36 for circulating the air in the space 32 intended for pre-cooling, in order to utilize at maximum the cold content of the cooling air. In order to yield a better coefficient of heat transfer from air to wall, the cooling air should be given a speed of about 10 m/s at the contact surfaces being cooled. The area of the space 32 being 24 $m^2$, an air speed of 10 m/s implies 240 $m^3$/s. This quantity results in unreasonable air speeds in the cooling air raises or in unreasonably large or in an unreasonable number of cooling air raises with reasonable air speed.

Therefore, a maximum utilization of the cold content of the cooling air must be effected with moderate air speed (~100 $m^3$ per second/24 $m^2$=~4 m/s) in the space. This is brought about by the aforesaid auxiliary fans 36, which cause local turbulence of the cooling air, corresponding to an air speed of 10 m/s. This relation is illustrated in FIG. 14 by the dashed ovals about the fans 36.

Figure 15:
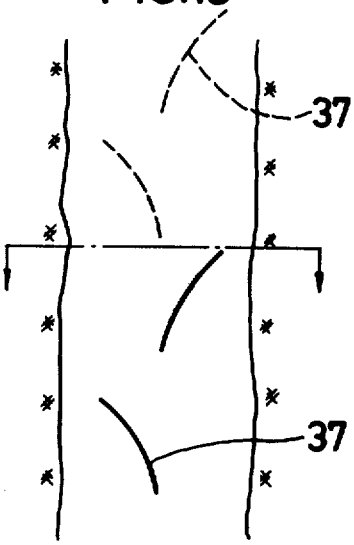
FIGS. 15 and 16 is a view of another example of an arrangement for creating turbulence.
Figure 16:
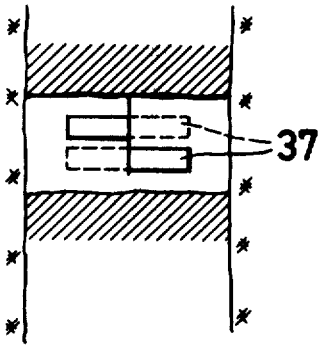

The same desired turbulence of the cooling air can be effected by arranging baffles 37, instead of air circulation auxiliary fans, in the spaces according to FIGS. 15 and 16. The baffles 37 are made of an inexpensive material, such as thin-walled metal sheet, plastic, cardboard or the like.

It should be apparent from the aforesaid, that correct application of the present invention not the least is a problem of optimization, at which parameters like supply and cost of electric energy, in situ rock temperature, atmospheric air temperature, production volume, ore value, ore configuration etc. must be taken into consideration. Also within the core of the present method, viz. the "three-step freezing", the parameters such as final temperature for the ice, depth and temperature gradient of the cold barrier, freezing times, cooling air volume and speed, can be varied and optimized, as mentioned before.

In this connection, a further variant with respect to the size of the cooling air volume can be mentioned. The variant is described with reference to FIGS. 17–20.

Figure 17:
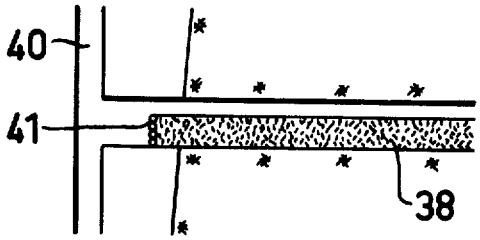
FIGS. 17–20 are illustrative examples of arrangement for varying the cooling air volume.
Figure 18:
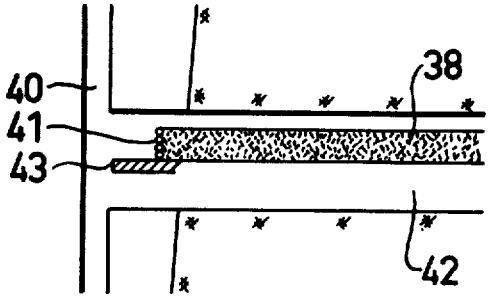
Figure 19:
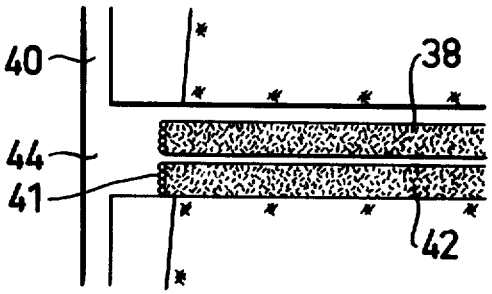

As shown in FIGS. 17–19, the following occurs when only one layer at a time is mined by downward mining.

In connection with the mining of the first layer 38, the space must be connected to the raises 40. As the height of the layer is 4 m, and the minimum height for the connecting raises at mechanized driving is 3 m, a rock portion 43 of only 1 m thickness is to remain when the second layer 42 is mined and connected to the cooling air raises. In practice this is difficult to realize and, therefore, the connecting raise most simply is given a height equal to that of the space, i.e. 4 m.

Furthermore, a barrier 41 must be built when the ice production is being commenced, in order to define the ice block 38 against the raise 40. This barrier 41, furthermore, can be arranged at any optional place and, consequently, the upper portion of the raise 40, which should be utilized for the transport of cooling air, can be given an area greater than 9 $m^2$ without appreciable cost increase. The cooling air volume thereby can be increased substantially, without greater aerodynamic losses exceeding those previously mentioned about 100 $m^3/s$.

The only limitation for the raise area is the strength of the rock.

Figure 20:
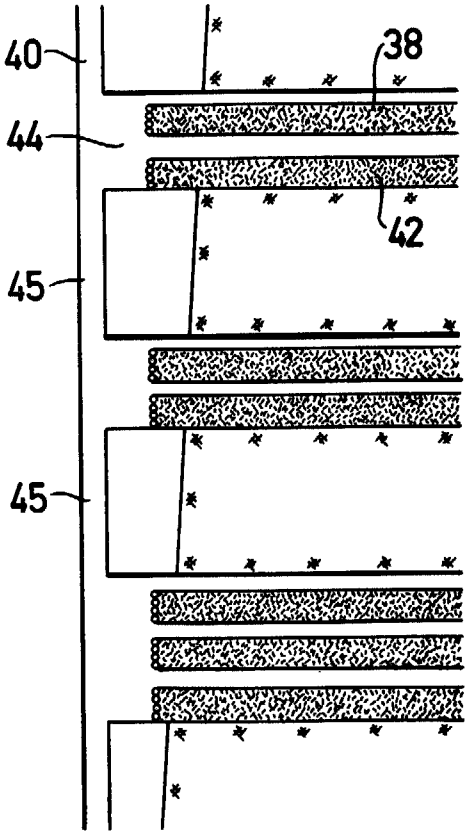

FIG. 20 shows the situation when more than one layer is mined at the same time.

The principle is the same as above, with the restriction, however, that the greater raise area 44 obtained by the mining is "throttled" in the places 45 where the mining has not yet been carried out.

This situation, seen on the whole, should lead to improvements, in spite of the aerodynamic losses at the narrow passages 45. In practice and during the first timing time in an ore block when several levels are mined at the same time, it probably is better to permit slightly longer cooling and freezing times owing to a slightly smaller air volume than to arrange auxiliary fans or baffles in the spaces.

Under more normal conditions, i.e. under rock conditions worse than implicitly assumed at the example according to FIGS. 1–9, the mining of layers having the same height and the simultaneous mining of every second layer cannot be expected to be possible. This situation is illustrated schematically in FIG. 21.

$h_e$ designates the level higher (distance) in a mine. It usually is about 50 m or a multiple thereof. S (layer) designates the layer number within the level height $h_e$. It follows from the previously assumed layer height $h_s=4$ m, that the number of layers within the level height $h_e$ is 12. Assuming that the level is developed through an adit on the upper level $N_0$ and an adit on the lower level $N_1$ and other necessary development work, such as for example vertical chute and ventilation shaft between the levels (not shown in FIG. 21) and a cooling air ventilation system (not shown in FIG. 21) required for the method, it follows that the level is ready for mining at any height within the level. It is one advantage of the method, that it allows mining of a layer to commence at any height within the level. The level being developed in advance, it is desired to obtain maximum production from the level in order to reduce the capital cost. When assuming that, from a rock strength point of view and for safety reasons connected therewith, a rock portion (layer) with a height corresponding to at least two layer heights shall remain between two layers where production is going on with upward mining, it follows with $\Delta h=2\ h_s$ that during a first operation phase a in the level four layers, viz. layers 1, 4, 7 and 10, can be mined simultaneously.

After said layers 1, 4, 7 and 10 have been filled with ice, theoretically one can choose in the subsequent operation phase b either to continue with upward mining direction, viz. to mine the layers 0 (not shown in FIG. 21), 3, 6 and 9, or to change to downward mining direction by mining the layers 2, 6, 8 and 11. Upward direction would be in a state of opposition to the aforesaid stipulation $\Delta h=2\ h_s$.

For the subsequent operation phase b, consequently, downward mining direction is chosen, and the layers 2,5,8 and 11 are mined.

The same reasoning as for operation phase b applies to operation phase c.

Another great advantage of the method is the possibility of mining in downward direction with all its advantages over upward mining, such as work under artificial roof, possibility of vertical chute in the space in solid rock etc.

Figure 21:
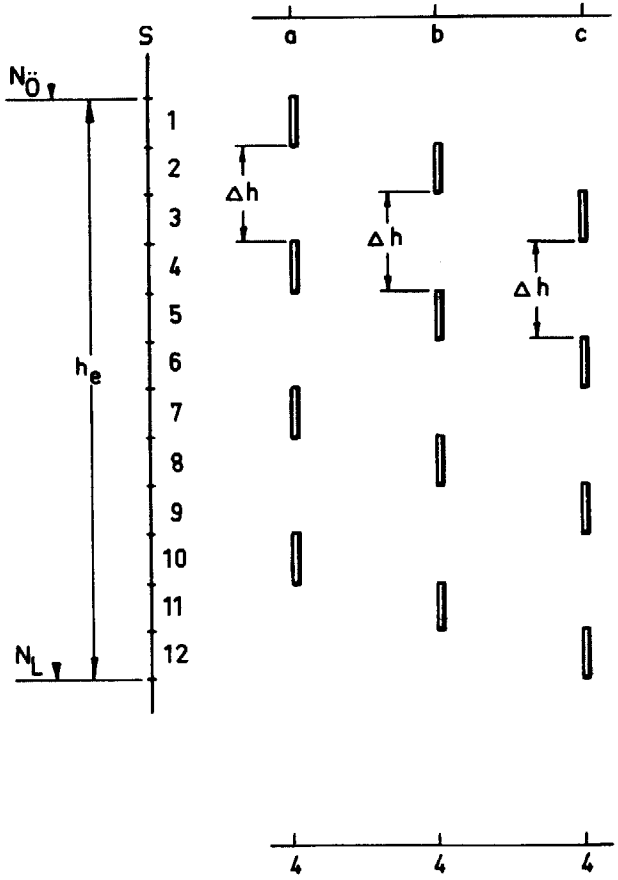
FIG. 21 is a view of a planning example concerning the mining of layers.

As appears from FIG. 21, within the level four layers always can be in production simultaneously. This is a third very essential advantage of the method, viz. a substantially higher and built-in production potential compared with conventional cut-and-fill mining with hydraulic fill. Said lastmentioned method usually does not permit the criterium $\Delta h=2\ h_s$ to be stipulated. It leads with $\Delta h=H_s$ to so-called "last-layers", i.e. layers with substantially reduced production pace due to large extra reinforcement work etc.

Figure 22:
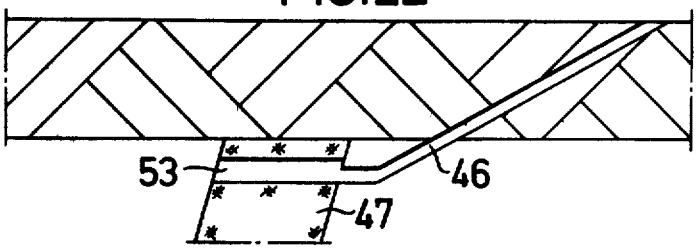
FIGS. 22–24 are views illustrating one of the advantages of the present invention.
Figure 23:
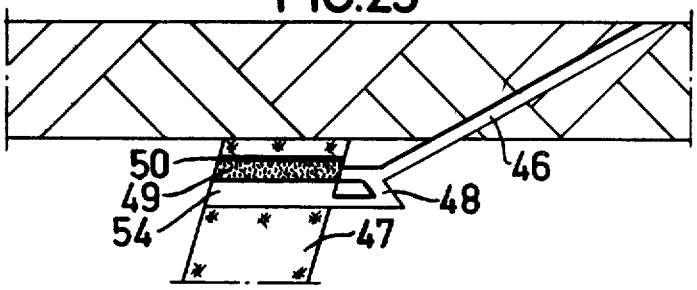
Figure 24:
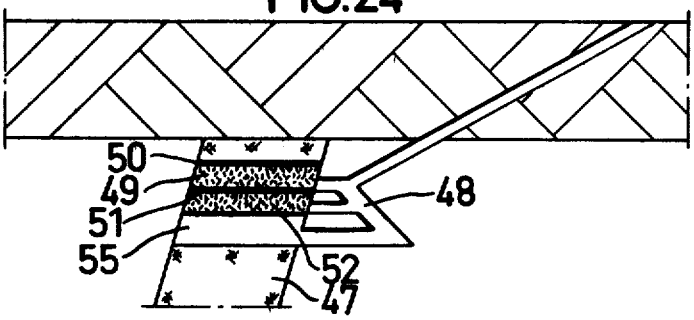

As a fourth highly essential advantage of the method can be mentioned the possibility of earlier yield by the method compared with conventional cut-and-fill mining with hydraulic fill. The method permits downward mining direction and, therefore, a mineral deposit or a part thereof must not be developed completely with vertical chute, ventilation shaft etc. but can be taken into production directly and as soon as the deposit has been reached. This is illustrated in FIGS. 22–24. The production can be commenced directly after a main platform (or a shaft) has reached the deposit 47. Downward mining is applied, and continued development through a secondary platform 48 proceeds at the same pace as the mining continues. By utilizing this advantage fully or partially, large captial cost reductions are possible. As the downward mining proceeds, the roof is filled with ice 49 with cooling gap 50 and, respectively, ice fill 52 and cooling gap 51. The mining space is designated by 53, 54 and, respectively, 55.

It can be asserted that the two lastmentioned advantages of the method can be obtained also with cement-stabilized hydraulic fill. This can be rejected by the argument that the lastmentioned method requires access to a suitable fill, cement, sand and water. The present method requires only water, and its cost as stated previously is only of the magnitude half the cost of cut-and-fill with cement-stabilized fill.

The above description of the present invention, with respect to its realization in practice, mainly has referred to the mining of inclined, preferably steeply inclined and even vertical mineral deposits or cavities where, besides, the thickness of these objects has been relatively limited.

The invention, of course, also can be applied to the mining of flat mineral deposits or to the preparation of rock cavities and/or thick mineral deposits (rock cavities) and/or under conditions where the flatness and great thickness are in combination.

This possibility has been indicated previously in the description, and the term "multiple space widths" has been mentioned.

However, when the invention is applied in practice under the aforesaid conditions, viz. flat deposit and/or great thickness, also other factors are of importance and must be observed, as appears from the following and is described with reference to FIG. 25.

Figure 25:
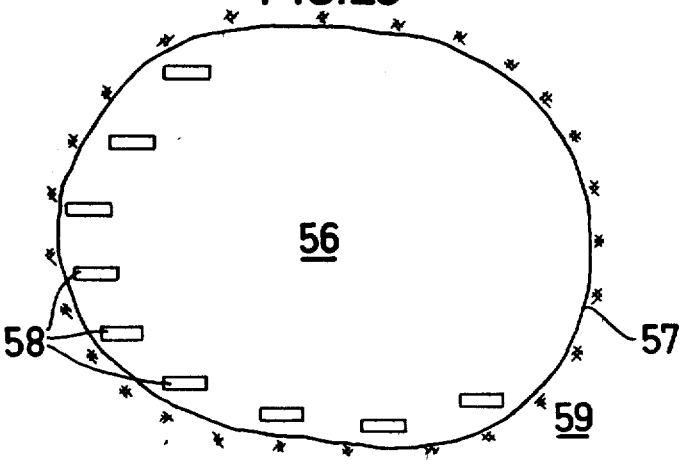
FIGS. 25–28 are schematic views of the invention applied to deposits with great depth.

FIG. 25 is a vertical section, shown schematically, through a former mineral deposit of great thickness. The hollow space obtained by mining has been filled with ice 56. The outer defining surface (periphery) for the ice fill is designated by 57, and the surrounding rock is designated by 59.

As explained previously, the pre-cooling and the maintenance cooling of the ice fill 56 are method steps, which must be taken, if the conditions so require in order to create and, respectively, maintain a cold barrier against the geothermic heat surrounding a hollow space in the rock and thereafter acting upon it continuously. In relation to the size of the hollow space, these possible method steps are caused by peripheral phenomena, i.e. phenomena occurring along the periphery 57 of the hollow space. When the hollow space is large, as indicated in FIG. 25, maintenance cooling scarcely must be applied, both for the aforesaid reason and because the ice has a relatively poor heat transfer capacity in the inner and ice-filled parts of the hollow space. Maintenance cooling can, but must not be applied. In FIG. 25, which shows the hollow space filled by the ice-fill 56 and indicated by its periphery 57, maintenance cooling is applied in the cooling slits 58 for an optionally selected time only along the periphery 57 of the hollow space toward the surrounding rock 59. The cooling slits 58, so to speak, insulate the interior of the ice-fill 56.

This results in the following situation shown in FIG. 26, which illustrates schematically the mining process according to the invention at a mineral deposit of great thickness by way of a vertical section.

A massive and/or large-size mineral deposit (rock cavity) is mined (prepared) by applying the "multiple space" principle. In FIG. 26 the spaces $r_1$, $r_2$ and $r_3$ are mined as parallel spaces of equal size on level $n_1$. For example, the distance $a_1$, $a_2$ between the spaces has been chosen, for reason of standardization, to be equal to the width of the spaces $r_1$, $r_2$ and $r_3$. The spaces resulting from the mining are filled with ice $i_1$, $i_2$ and $i_3$, whereby the cooling gaps $s_1$, $s_2$ and $s_3$ remain free. When mining the spaces $r_4$ and $r_5$ between the spaces $r_1$, $r_2$ and $r_3$, the existence of the cooling gaps $s_1$, $s_2$ and $s_3$ must be observed. In order to prevent the closed cooling ventilation system from becoming an open one, i.e. cut-through between the cooling gaps $s_1$, $s_2$ and $s_3$ with the cooling gaps for $s_4$ and $s_5$ for the spaces $r_4$ and $r_5$, the spaces $r_4$ and $r_5$ must be arranged on another level than on level $n_1$, namely on level $n_2$, when for the spaces $r_4$ and $r_5$ the same dimension is chosen as for the spaces $r_1$, $r_2$ and $r_3$. The difference in level $\Delta h$, for understandable reasons, must be greater than the height of the cooling gap.

Figure 26:
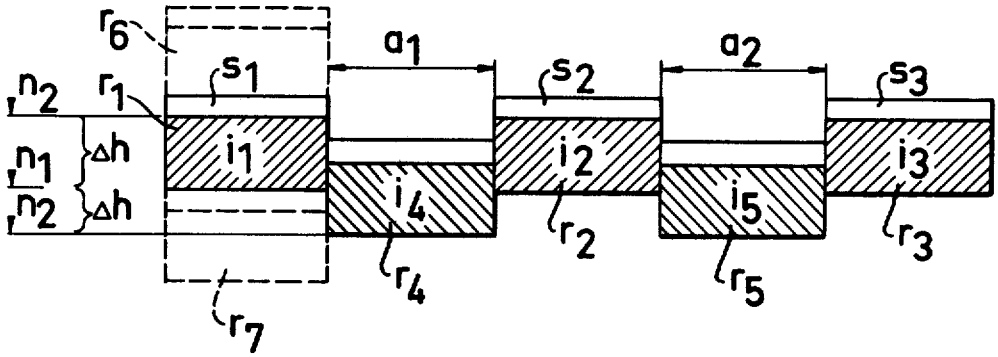

For the continued mining (preparation) of the mineral deposit (rock cavity), usually upward or downward mining direction can be chosen, as indicated in FIG. 26 through the space $r_6$, upward, and $r_7$, downward.

Figure 27:
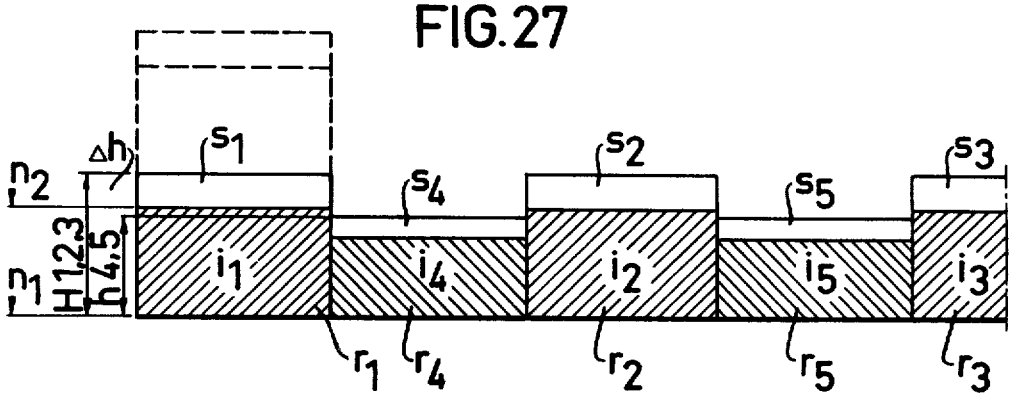

The same object, i.e. to prevent cut-through between the closed cooling air system and the normal ventilation system in a space being mined, can be achieved by giving the spaces on the level $n_1$ different heights H and h as shown in FIG. 27.

The difference in the height $\Delta h$ is at least equal to the cooling gap height. On level $n_2$, in either upward or downward direction, the space height again is equal for all spaces. From a purely practical point of view, a method according to FIG. 27 should be preferred to a solution according to FIG. 26, because an even sole without steps is obtained, which facilitates the movements of machines and personnel.

In the phases heretofore described in greater detail with respect to mining (preparation) of large mineral deposits (rock cavities) cooling gaps have been indicated in FIGS. 25, 26 and 27, in spite of the introductory statement that the maintenance cooling in the inner, not peripheral, parts of an ice-filled deposit (rock cavity) is not necessary.

Figure 28:
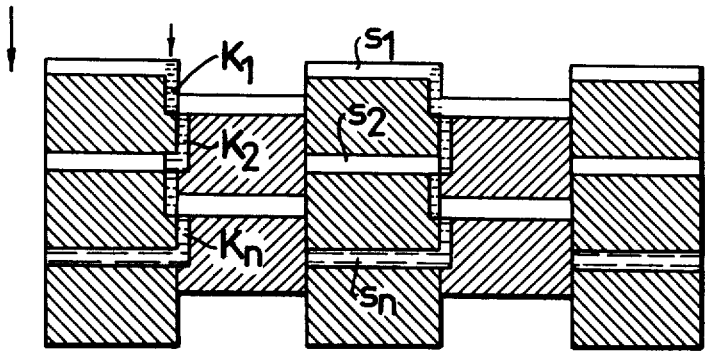

These gaps, for understandable reasons, are abolished automatically at upward mining direction. At downward mining direction, however, such gaps are obtained automatically according to the method described above. These cooling gaps S can be filled with ice according to FIG. 28. It should even be desirable to fill them, in order thereby to increase the stability of the ice-fills still more and for avoiding too many hollows.

For this reason, channels $K_1$ are provided at the ice production, through which water is supplied for filling the initially created cooling gaps $S_{1 \to n}$ after several layers have been mined.

Assuming that the ice during the manufacturing has been given a temperature of preferably −15° C., and that this temperature later on, during a certain period of maintenance cooling, had been maintained, and assuming further that the water temperature is almost zero at the supply to fill the gaps, and further assuming that the height of the ice beam is 3 m and the gap height is 1 m, then the lower temperature of the total ice mass is about −11° C., and the strength of the ice is sufficient to achive the object.

It should further be stated with respect to mining (preparation) of large mineral deposits (rock cavities), that at relatively low in situ rock temperatures and at upward mining direction in the inner, not peripheral parts of the deposit (rock cavity) the so-called pre-cooling step should not be attached too great importance to, and that the step in many cases, even at in situ temperatures above 0° C., probably can be abolished entirely or at least shortened very substantially.

As appears from the above, according to the invention a method of underground mining of mineral or preparation of rock cavities is provided, at which full mining of the mineral body or cavity can be carried out, and at which the disadvantages of known methods mentioned in the introductory portion are eliminated and, among others, the following advantages are obtained.

The method permits complete selectively with respect to the underground location of the mining place and, in the case of underground mineral mining, to the quality of the production, i.e. the quality is improved by holding gangue admixture at a minimum, compared with other methods.

The method renders possible a substantially complete mineral extraction, because the method is a cut-and-fill method at which hollow spaces created in the rock are stabilized by fill.

The fill is water in the form of ice. Water is a material, which under normal conditions is more easily available than other suitable fill.

Due to the fact, that the ice used for stabilization purposes at the method can be maintained even after the mining of an entire mineral deposit, or of parts thereof, has been completed, the method is safe against collapse risk.

Owing to the fact that with the method downward mining direction can be applied in a simple manner, and even it is to be preferred to upward mining direction for economic reasons due to the possibility of only partially filling a mining space (maintenance gaps) with ice, the work on the mining space proceeds under an artificial roof and thereby under conditions, which can be controlled better than usually is the case with other methods.

Downward mining direction provides the possibility of vertical chutes in the mining spaces without requiring extra reinforcing work or other auxiliary means, such as sheet metal shaft etc.

Due to the fact that, contrary to what previously has been said, at the initial phase of ice-freezing of an ice layer a substantially higher water layer is supplied to create an ice film on the surface thereof, whereafter normal freezing of ice layers is continued according to the description above and the water volume beneath the ice mass is drained, a space is produced which can be used at downward mining for pushing up the layer next below. The same method can be imagined to be used for bringing about cooling gaps.

Downward mining direction renders it possible to start operation at a deposit as soon as the mineral zone has been reached, without requiring the deposit to be prepared for mining on a larger scale before the start of the production. The capital cost can thereby be reduced substantially.

When a deposit or part of a deposit is prepared in advance, substantial production increases from and within the prepared area can be obtained by applying the present method due to its possibilities of simple mining in downward direction. The method, thus, has a large capacity potential and thereby a large potential of lowering the capital cost also in this respect.

The method has an environment protective potential, because waste grain fractions difficult to handle easily can be "baked in" in the ice and even improve the strength properties of the ice. The same applies to metal ions, but of course without the strength improving effect.

The method can excellently be used at the mining of minerals easily oxidizing, i.e. which have the tendency of self-ignition, because the mine ventilation temperature is low, and low temperatures have a retarding effect on the oxidation process.

The method is substantially cheaper from a cost aspect than, for example, cement-stabilized hydraulic fill, but involves all the advantages of this latter method. The favourable cost situation of the method not the least is based on the fact, that one kWh electric energy corresponds at least two kWh cooling energy.

When the invention is applied to the preparation of rock cavities for the storage of solid, gaseous and/or liquid media, corresponding advantages are obtained also in this case although no ore is produced.

The embodiments of the invention shown and described, of course, are only examples and variations within the scope of the attached claims is possible without departing from the spirit of the present invention.

What has been stated above with respect to mineral deposits and rock cavities, applies where applicable also to coal deposits or fossil fuels other than coal.

What we claim is:

1. A method of underground mining of mineral-bearing rock or of preparation of rock cavities, in which hollow spaces resulting from the mining or preparation of rock cavities at least partially can be refilled at least temporarily with stabilizing ice, and in which the resulting hollow space is prepared for ice filling by treating walls of the hollow space with respect to the geothermic heat content of the surrounding rock, and in which water is supplied to the hollow space while being cooled and frozen by air, and in which the ice body formed is maintained, the improvement comprising preparing the resulting hollow space in a first step for a predetermined time for ice filling by removing a portion of the geothermic heat content in the walls of the hollow space such that the walls assume a temperature below 0° C., and in a second step supplying the water intermittently to form layers in the hollow space, cooling and freezing the supplied water, in a third step removing the constantly inflowing geothermic energy for a predetermined period for maintaining the frozen ice body, said cooling and freezing in all three steps being carried out with artifically cooled air which flows within a closed system entirely separated from normal ventilation air.

2. The method as defined in claim 1, wherein the cooling in all three steps is carried out with flowing air of a controlled volume and temperature, said air being artifically cooled to a temperature between 0° C. and −10° C.

3. The method as defined in claim 2, further comprising supplying a suitable quantity of atmospheric air in periods and intermittently to the closed cooling air system when atmospheric temperature conditions permit for compensating for an increase in the temperature of the cooling air beyond the desired temperature due to heating of the cooling air by geothermic heat.

4. The method as defined in claim 2, further comprising analyzing the cooling and freezing time periods, the cooling and freezing air volumes and the cooling and freezing air temperature, together with natural parameters such as the geothermal heat of the rock and the temperature of the atmospheric air prevailing in the place in question in order to determine economically optimum conditions and yields, and controlling the parameters directly controllable in the system to obtain said optimum conditions by a process computer.

5. The method according to claim 2, wherein the air is artificially cooled to a temperature below −15° C.

6. The method as defined in claim 1, wherein in the first step the walls of the hollow space over a layer at least several decimeters thick are frozen by flowing air to a temperature below 0° Celsius.

7. The method as defined in claim 1, wherein the flowing air in the second step is introduced intermittently substantially in pace with the intermittent water supply such that the cooling air is at least partially stopped during the water supplying periods and is permitted to flow with full speed and to freeze the supplied water layer when no water supplying takes place.

8. The method as defined in claim 1 or 7, further comprising the steps of producing a speed of the cooling air by fans, baffles or dampers within the closed system such that the contact surfaces exposed to the cooling are supplied with sufficient cooling energy required for cooling the contact surfaces to the desired temperature within a reasonable time, and scanning the contact surfaces to obtain impulses and information for control and adjustment by process computers of the speed of the cooling air.

9. The method as defined in claim 1, wherein the stabilization of the hollow spaces in the rock is achieved by utilizing the static physical and strength properties of the ice within the temperature range 0° C. to below −15° C., and preferably within the temperature range −10° C. to −15° C.

10. The method as defined in claim 1, further comprising permitting the ice bodies in the hollow spaces filled in the rock to at least partially melt after a predetermined time period, cooling water required for the ice filling of a hollow space in the rock other than the space wherein ice melting occurs by heat exchange with air cooled during melting.

11. The method as defined in claim 1, further comprising utilizing the frozen ice bodies in the hollow spaces obtained in the rock during continued mining or continued removal of rock as working platforms for the continued work, when the continued work is carried out in an upward direction, or as a roof when the continued work is carried out in a downward direction, said ice roof being substantially safer and permitting easier control of the working environment than beneath a natural rock roof.

12. The method as defined in claim 11, further comprising reducing preparatory work in the downward direction in the mining of mineral-bearing rock or mining of rock cavities which work otherwise would be necessary.

13. The method as defined in claim 12, wherein the material is fine-grained or fibrous material comprising waste from mineral dressing plants, the fine grained material being baked into the ice.

14. The method as defined in claim 1, wherein the mining of mineral deposits or preparation of rock cavities is of great width, and further comprises maintaining gaps for the cooling air for maintaining the frozen ice body only in the peripheral portions of the ice body.

15. A method of underground mining of mineral-bearing rock or of preparation of rock cavities, in which hollow spaces resulting from the mining or preparation of rock cavities at least partially are refilled with ice which due to a cold climate automatically permanently stabilizes in a natural way, and in which water is supplied to the hollow space while being cooled and frozen by air, and in which the ice body formed is maintained, the improvement comprising preparing the resulting hollow space in a first step for ice filling by cooling, in a second step supplying the water intermittently to form layers in the hollow space, cooling and freezing the supplied layers of water individually to form an ice body, in a third step maintaining the frozen ice body, said cooling and freezing in the first and third steps being accomplished primarily by using the permafrost of the cold climate and in the second step primarily by naturally cooled air of the cold climate, the naturally cooled air flowing within a closed system entirely separated from normal ventilation air.

16. The method according to claim 1 or 15, further comprising the step of adding material to the water supplied intermittently for increasing the strength of the ice body.

* * * * *